US011754242B2

(12) United States Patent
Gloss et al.

(10) Patent No.: US 11,754,242 B2
(45) Date of Patent: Sep. 12, 2023

(54) LIGHTING MODULE, IN PARTICULAR FOR A VEHICLE LIGHTING DEVICE AND A VEHICLE LIGHTING DEVICE

(71) Applicant: Varroc Lighting Systems, s.r.o., Senov u Noveho Jicina (CZ)

(72) Inventors: Tomas Gloss, Vitkov (CZ); Michal Borek, Koprivnice (CZ); Michal Juhanak, Koprivnice (CZ)

(73) Assignee: VARROC LIGHTING SYSTEMS, S.R.O.

( * ) Notice: Subject to any disclaimer, the term of this patent is extended or adjusted under 35 U.S.C. 154(b) by 0 days.

(21) Appl. No.: 17/364,973

(22) Filed: Jul. 1, 2021

(65) Prior Publication Data

US 2022/0003372 A1 Jan. 6, 2022

(30) Foreign Application Priority Data

Jul. 3, 2020 (CZ) ..... PV 2020-393

(51) Int. Cl.
*F21S 41/141* (2018.01)
*F21S 41/20* (2018.01)
(Continued)

(52) U.S. Cl.
CPC ..... *F21S 41/141* (2018.01); *F21S 41/285* (2018.01); *F21S 43/14* (2018.01); *F21S 43/26* (2018.01); *F21V 23/005* (2013.01)

(58) Field of Classification Search
CPC ..... F21S 41/141; F21S 41/285; F21S 43/14; F21S 43/26; F21V 23/005
See application file for complete search history.

(56) References Cited

U.S. PATENT DOCUMENTS 9,599,292 B2 3/2017 Jagt et al.
2011/0299270 A1 12/2011 Kojima et al. ..... 362/97.1
(Continued)

FOREIGN PATENT DOCUMENTS

CZ 2012-674 A3 11/2012
EP 2 748 872 B1 3/2020
(Continued)

OTHER PUBLICATIONS

Search Report dated Nov. 27, 2020 in corresponding Polish Patent Application No. PV 2020-393.

*Primary Examiner* — Christopher E Dunay
(74) *Attorney, Agent, or Firm* — OSTROLENK FABER LLP

(57) ABSTRACT

A lighting module including a housing with a cavity enclosed with a light-emitting surface and in which an LED is mounted connectable to a power source and possibly also to a control circuit. Between the LED and the light-emitting surface is arranged a transparent optical filter having an upper surface and a lower surface. The upper surface is adapted for the passage of a minor portion of light from the cavity of the housing to the light-emitting surface and, at the same time, the upper surface is adapted to reflect most of the light from the cavity of the housing back to the lower surface. On the lower surface of the transparent optical filter facing the LED is arranged a spatial optical structure adapted to scatter light from the cavity of the housing onto the upper surface and at the same time is adapted to scatter light reflected from the upper surface back to the spatial optical structure opposite the bottom of the cavity of the housing and possibly also opposite the side surfaces of the cavity of the lighting module.

5 Claims, 7 Drawing Sheets

(51) Int. Cl.

| | |
|---|---|
| ***F21V 23/00*** | (2015.01) |
| ***F21S 43/20*** | (2018.01) |
| ***F21S 43/14*** | (2018.01) |

(56) References Cited

U.S. PATENT DOCUMENTS

| | | | | |
|---|---|---|---|---|
| 2012/0075870 | A1* | 3/2012 | Kayanuma | F21V 5/045 362/311.06 |
| 2012/0268940 | A1* | 10/2012 | Sahlin | F21S 43/255 362/290 |
| 2013/0328090 | A1* | 12/2013 | Park | F21S 41/192 257/98 |
| 2014/0204592 | A1* | 7/2014 | Miyashita | F21V 5/002 362/311.06 |
| 2017/0184275 | A1* | 6/2017 | Aruga | H01L 33/58 |
| 2018/0188438 | A1* | 7/2018 | Chen | B60Q 1/22 |
| 2018/0210135 | A1* | 7/2018 | Randolph | G02B 6/0036 |
| 2020/0141555 | A1* | 5/2020 | Streppel | G02B 19/0066 |

FOREIGN PATENT DOCUMENTS

| | | |
|---|---|---|
| WO | WO 2008/144644 A2 | 11/2008 |
| WO | WO 2010/124158 A1 | 10/2010 |

* cited by examiner

BACKGROUND ART

LIGHTING MODULE, IN PARTICULAR FOR A VEHICLE LIGHTING DEVICE AND A VEHICLE LIGHTING DEVICE

TECHNICAL FIELD

The invention relates to a lighting module, in particular for a vehicle lighting device, which comprises a housing with a cavity which is enclosed with a light-emitting surface and in which an LED is mounted, the LED being connectable to a power source and possibly also to a control circuit.

The invention also relates to a vehicle lighting device comprising at least one lighting module.

BACKGROUND ART

A variety of light sources are used in vehicle lighting devices, etc., including LED point light sources. If there is a need to create a larger light-emitting surface of a vehicle lighting device, various basic concepts are available, which can be divided according to the position and orientation of the light sources relative to the light-emitting output surface of the lighting device into modules with direct illumination and modules with indirect illumination.

An example of a module with indirect illumination is an S-LED solution, see FIG. 1, where the LEDs are oriented perpendicular to the side edge of the light-emitting surface (or a flat light guide), whereby the light emitted by the LED is led out of the light-emitting surface in a controlled manner and oriented into the desired direction, which is different, e.g. perpendicular, to the original direction of the light emitted by the LED. The advantage of this concept is very good homogeneity of the illumination of the output surface, which is comparable to OLED, as well as a very small depth of the lighting device installation. The disadvantage of this concept is minimal possibility of animation of the illuminated surface.

In modules with direct lighting, see FIG. 2, one or more LEDs are located behind the output surface and are oriented in such a manner that they directly illuminate this output surface in the direction in which the light is subsequently emitted by the output surface. The advantage of such solutions with direct lighting is the improvement of the possibility of controlling the animation of the light output. In addition, by placing the LEDs directly behind the output light-emitting surface, it is possible to create sharply defined segments of different shapes by means of partitions between the individual LEDs. These segments can then light up independently of the other segments in the light-emitting surface of the vehicle lighting device. The disadvantages of modules with direct lighting generally include worse homogeneity of the outgoing light and a greater depth of installation. LEDs are point light sources with a certain radiation characteristic and in the direction perpendicular to the chip they emit light with maximum intensity which decreases with an increasing radiation angle away from the direction perpendicular to the chip. In order to achieve the required homogeneity of illumination of the light-emitting surface with such sources, it is necessary to place the LED far enough from the illuminated light-emitting surface, which increases the requirements for the depth of installation of the lighting device. It is true that using standard primary optics leads to better control of the homogeneity of the illumination of the light-emitting surface, but there is further increase in the demands for the installation depth of the device.

U.S. Pat. No. 9,599,292 B2 and EP 2 748 872 B1 disclose a light emitting module which can be included among the modules with direct lighting. The light emitting module emits light through a light exit window and comprises a base, a semi-conductive light emitter and a partially diffusive reflective layer. The base has a light reflective surface which faces towards the exit window. The light reflective surface has a base reflection coefficient which is defined by a ratio between the amount of light that is reflected by the light reflective surface and the amount of light that impinges on the light reflective surface. A solid-state light emitter emits light of a first color range, includes an upper surface and has a solid state light emitter reflection coefficient which is defined by a ratio between the amount of light that is reflected by the solid-state emitter and the amount of light that impinges on the upper surface of the solid-state emitter. The largest linear size of the upper surface of the at least one solid state light emitter is defined as the longest distance from a point on the upper surface of the at least one solid state light emitter to another point on the upper surface of the at least one solid state light emitter along a straight line. The light exit window comprises at least a part of the partially diffusive reflective layer. The partially diffusive reflective layer that is both on the module walls and on the exit window contains phosphor that changes the wavelength of the light emitted by the light source.

The disadvantage of this solution is its manufacturing complexity with the necessity of precise observance of a number of parameters as well as precise observance of the composition and structure of the partially diffusive reflective layer used on the entire surface of the module. Due to the complexity of the whole concept and the use of phosphorus to change the wavelength, the efficiency of the whole system is also negatively affected.

The object of the invention is to eliminate or at least reduce at least some of the disadvantages of the background art, most of all, to reduce the manufacturing complexity and simplify the construction with a minimum installation depth and a homogeneous illumination of the output surface of the lighting device by means of LEDs placed directly behind the light-emitting surface of the lighting device.

Principle of the Invention

The object of the invention is achieved by a lighting module, in particular for a vehicle lighting device, whose principle consists in that between an LED and a light-emitting surface, a transparent optical filter having an upper surface and a lower surface is arranged between, the upper surface of the transparent optical filter being adapted for the passage of a small portion of light from a cavity of a housing to the light emitting surface and, at the same time, the upper surface of the transparent optical filter is adapted to reflect most of the light from the LED back to the lower surface of the transparent optical filter, whereby a spatial optical structure facing the LED is arranged on the lower surface of the transparent optical filter. The spatial optical structure is adapted to scatter light from the housing cavity to the upper surface of the filter and at the same time is adapted to scatter light reflected from the upper surface of the filter back to the spatial optical structure and against the bottom of the housing cavity and possibly also against the side surfaces of the cavity of the lighting module.

This solution makes it possible to achieve a high homogeneity of surface illumination of the light-emitting surface even in views at different angles with minimal thickness of the lighting module, which allows to create homogeneous animated or segmented illuminating surfaces with a thin profile. At the same time, it is also possible to create differently sized illuminating surfaces with individually controllable illuminating surface segments, which further increases the variability of constructions and design embodiments of vehicle lighting systems.

Preferred embodiments are the subject matter of the dependent claims.

The principle of the vehicle lighting device comprising at least one lighting module consists in that the lighting module is formed according to any of claims 1 to 10, giving the entire lighting device significant and advantageous properties.

DESCRIPTION OF DRAWINGS

The invention is schematically represented in a drawing, wherein.

EXAMPLES OF EMBODIMENT

The invention will be described with reference to several exemplary embodiments of a lighting module, in particular for a vehicle lighting device, and the operation of such a lighting module.

Figure 1:
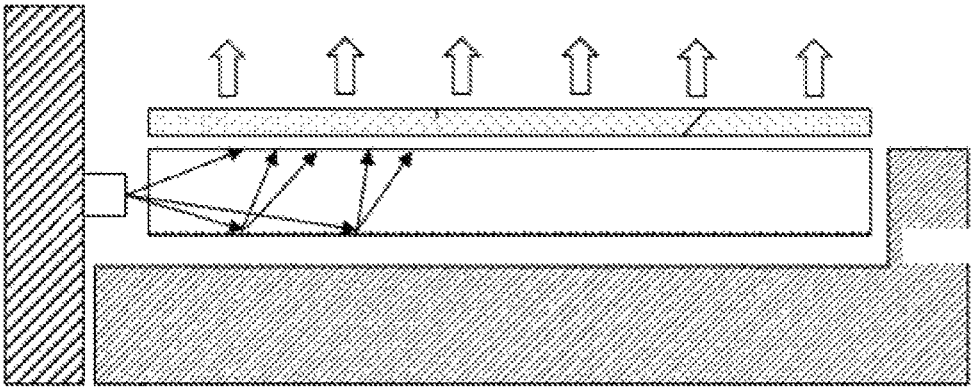
Fig. 1 BACKGROUND ART
FIG. 1 shows the background art in the field of indirect lighting module concepts.
Figure 2:
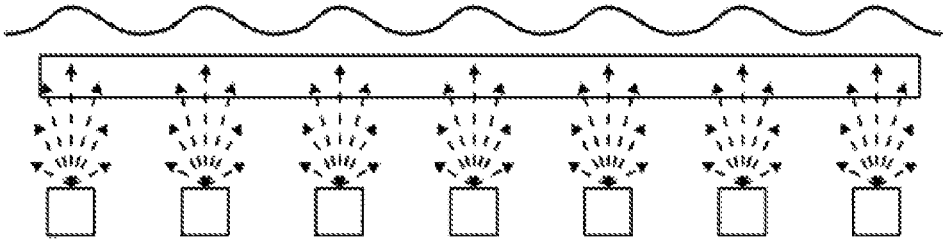
FIG. 2 shows the background art in the field of direct lighting module concepts.
Figure 3:
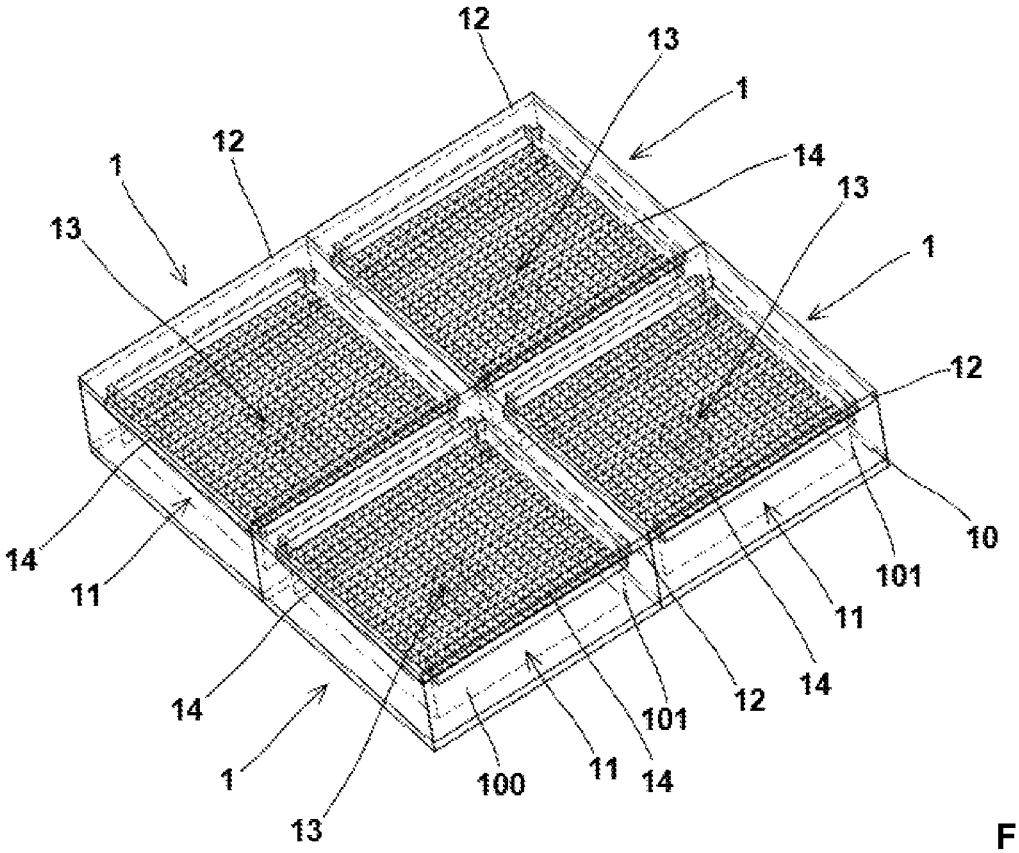
FIG. 3 shows a lighting device comprising a matrix of four lighting modules according to the invention.
Figure 4:
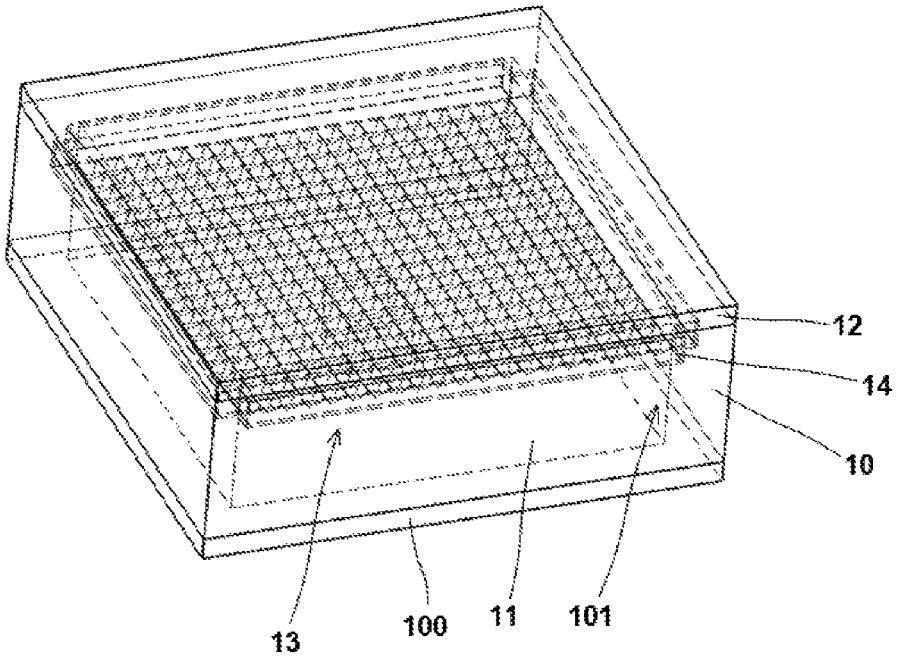
FIG. 4 shows a detail of a lighting module according to the invention.

FIG. 3 shows a matrix 4 of lighting modules 1 according to the invention, wherein each lighting module 1 comprises a housing 10, in which a cavity 11 is formed. The cavity 11 is covered and enclosed with a light-emitting surface 12, which is either a 2D surface or a 3D surface and which is separate for each of the lighting modules 1 or is shared by at least two adjacent lighting modules 1. The light-emitting surface 12 preferably consists of a diffusion foil, a matt filter or a milky filter which further scatters the incoming light into homogeneous outgoing light, which then has a homogeneous appearance even from different angles.

On the bottom 100 of the housing 10 in the cavity 11 is mounted one LED 13, which is connected to an unillustrated power source and possibly also to an unillustrated control circuit. The LED 13 consists of either a single color LED or an RGB LED. The LED 13 is preferably mounted on a PCB 15 with all the supporting circuits and elements for the operation of the LED 13.

Between the LED 13 and the light-emitting surface 12, a thin transparent optical filter 14 is arranged, either in the form of a plate or a foil which is on its lower surface 141 facing the LED 13 provided with a spatial (3D) optical structure 1410. The optical filter 14 is adapted to modify the passage of the light emitted directly from the LED 13, when the spatial (3D) optical structure 1410 scatters light coming directly from the LED 13, deflecting it sideways into the transparent optical filter 14, whereupon the light thus deflected is incident on the upper surface 140 of the filter 14, the upper surface 140 of the filter 14 being preferably smooth. On the upper surface 140 of the filter most of the deflected light will meet the condition for total internal light reflection and is therefore reflected back to the spatial (3D) optical structure 1410 within the filter material 14. This reflected (returned) light is transmitted by the spatial (3D) optical structure 1410 back into the cavity 11 of the housing, where both the bottom 100 of the housing, or PCB 15, and the side walls 101 are diffusive (ideally white and highly reflective) and further scatter this returned light. The spatial (3D) optical structure 1410 thus influences (reduces) the amount of light that passes through the filter 1410 relative to that which is returned to the cavity 11 of the housing 10 where the diffusion of this returned light occurs. Thus, at the light output from the housing 1 the influence of the diffuse environment is strengthened and the influence of the direct light from the LED 13 is weakened, so that the output light is homogenized.

Figure 10:
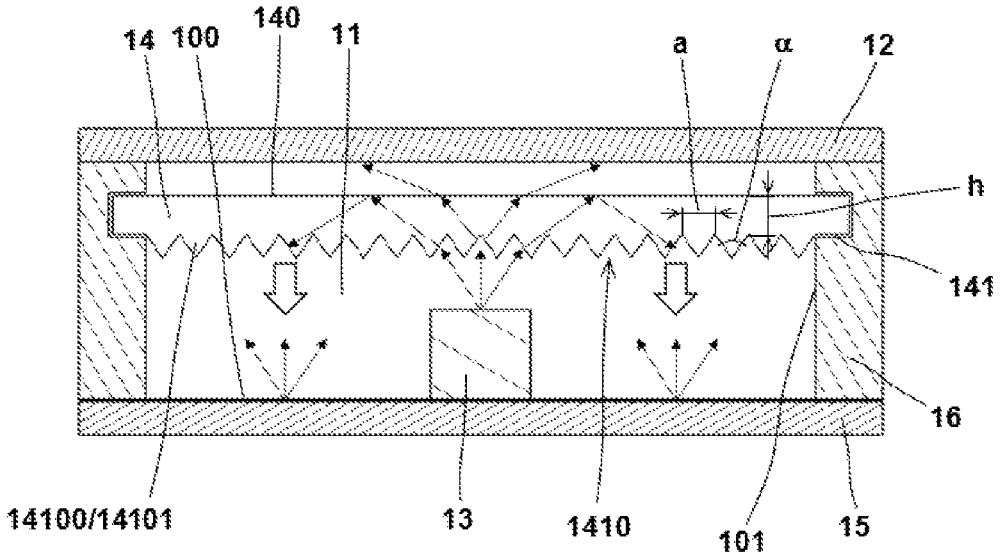
FIG. 10 shows the light function of the first embodiment of the lighting module according to the invention in cross-section.
Figure 11:
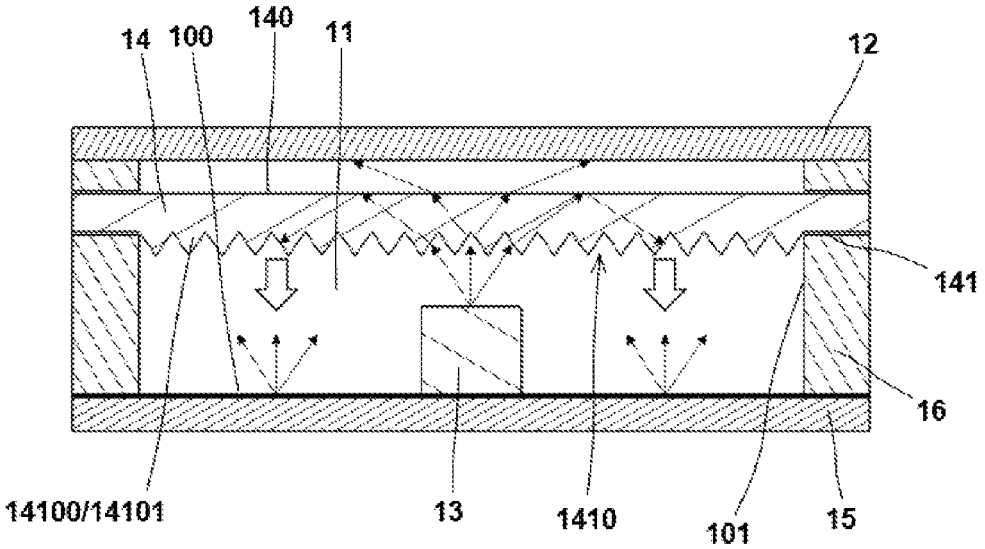
FIG. 11 shows the light function of the second embodiment of the lighting module according to the invention in cross-section.
Figure 12:
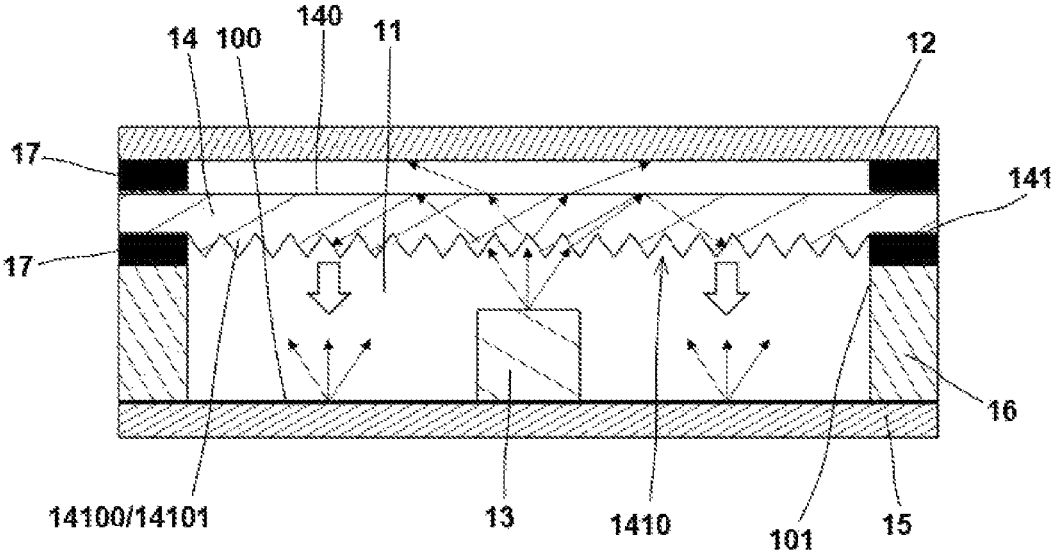
FIG. 12 shows the light function of the second embodiment of the lighting module according to the invention in cross-section.
Figure 13:
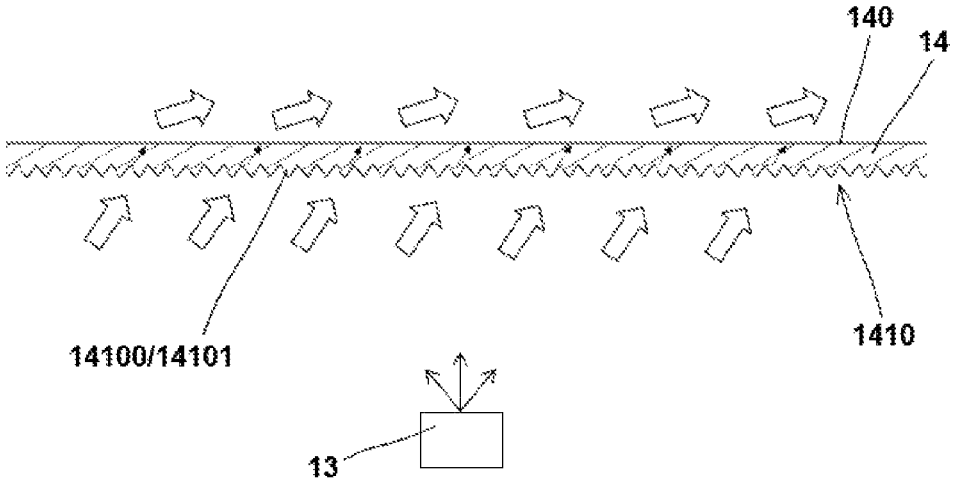
FIG. 13 represents the light function of the first embodiment of the light filter in a cross-sectional view and FIG. 14 shows the light function of an embodiment of the light filter with diffusion foil in a cross-sectional view.
Figure 14:
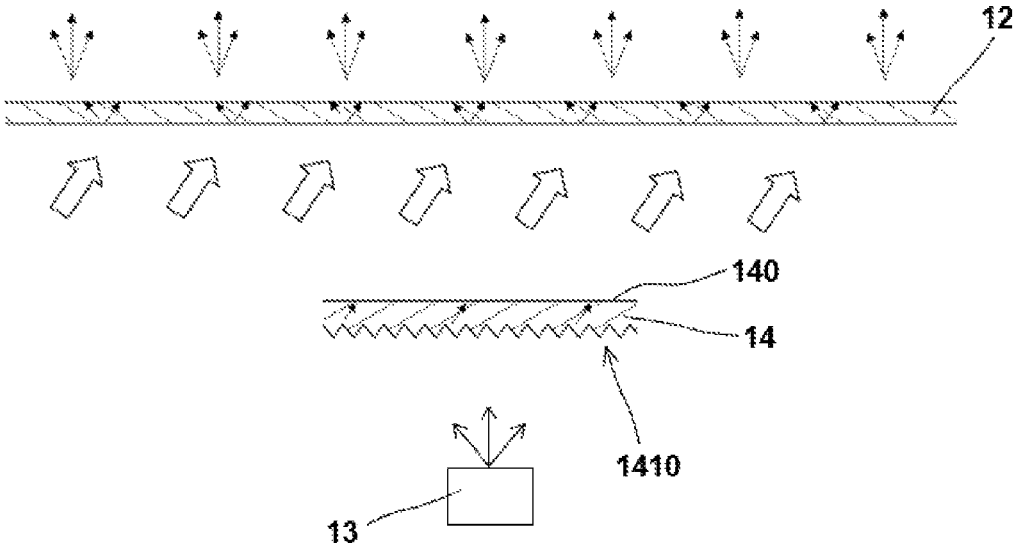

In other words, the light emitted from the LED 13 enters through the spatial (3D) optical structure 1410 the optical filter 14, where a minor portion of this light passes through the optical filter 14 onto the light-emitting surface 12, through which it passes and is directly emitted. The remaining, larger, portion of the light that enters the optical filter 14 from the LED 13 through the spatial (3D) optical structure 1410 is reflected back on the upper surface 140 of the optical filter 14, which faces the light-emitting surface 12 to the lower surface 141 of the optical filter 14, whereupon this reflected part of light passes again through the spatial (3D) optical structure 1410 on the lower surface 141 of the optical filter 14 towards the bottom 100 of the lighting module 1. When the reflected portion of light passes through the spatial (3D) optical structure 1410, this light is further scattered due to the shaping of the spatial (3D) optical structure 1410 towards the bottom 100 and possibly towards the side surfaces 101 of the cavity 11 of the lighting module 1, from which the scattered light is reflected back to the optical filter 14 through which part of the light passes again to the light-emitting surface 12 and part is again reflected from the upper surface 140 of the optical filter 14 towards the lower surface 141 of the optical filter 14 with the spatial (3D) optical structure 1410, etc. The scattering of light by the spatial (3D) optical structure 1410 leads to a more uniform illumination of the optical filter 14 and, as a result, a more uniform illumination of the light-emitting surface 12, as also shown in more detail in FIGS. 10 to 12, which show the passage of light from the LED 13 in the arrangements of the lighting module 1 according to FIGS. 7 to 9.

In an unillustrated embodiment, in order to improve the scattering of light when it is reflected from the bottom 100 of the lighting module 1, the bottom 100 and possibly also the side walls 101 of the cavity 11 of the lighting module 1 are provided with a diffusion layer.

Figure 5:
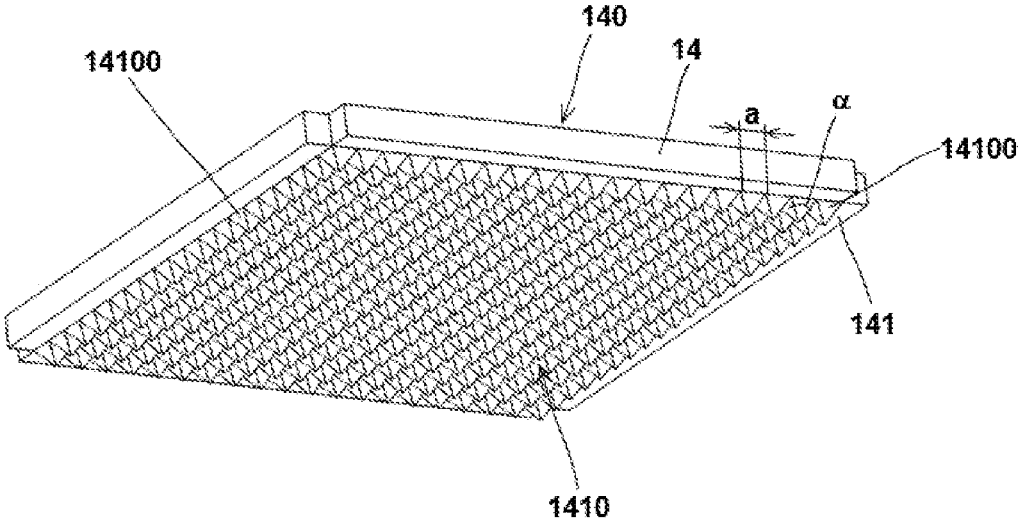
FIG. 5 shows a detail of the lower side of the first embodiment of the light filter.

In an exemplary embodiment in FIG. 5, the spatial (3D) optical structure 1410 is formed by a planar matrix (a planarly distributed set) of downwardly extending quadrilateral pyramids 14100, wherein these pyramids 14100 have a square base a and the apex angle α of the opening of the walls of the pyramids 14100 is in in the range of 60° to 80°, ideally 70°. Preferably, the edge size of the base a ranges from 1 μm×1 μm to 2 mm×2 mm, ideally 100 μm×100 μm. In an unillustrated embodiment, the pyramids 14100 have a different base shape and a corresponding number of side walls.

Figure 6:
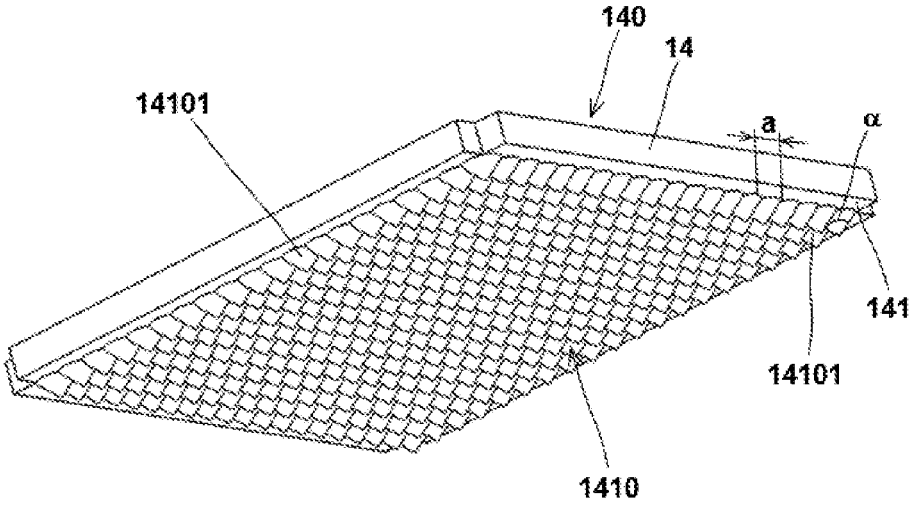
FIG. 6 shows a detail of the lower side of the second embodiment of the light filter.

The spatial (3D) optical structure 1410 in an exemplary embodiment shown in FIG. 6 is formed by a planar matrix of downwardly extending cones 14101, wherein these cones 14101 have a base diameter a and the apex angle α of the cones 14101 is in the range of 60° to 80°, ideally 70°. Preferably, the base diameter a is in the range of 1 μm to 2 mm, ideally 100 μm.

In an unillustrated embodiment, the spatial (3D) optical structure 1410 is formed by a planar matrix of downwardly extending different bodies of suitable geometry and dimensions.

The transparent optical filter 14 is made of an optically suitable material, preferably of a material having a refractive index in the range of 1.2 to 1.8, ideally 1.586, in particular it is made of polycarbonate.

The transparent optical filter 14 has a thickness h of the base body, i.e., a thickness h of a full profile without a spatial (3D) optical structure 1410 in the range of 1 μm to 3 mm, ideally 300 μm.

Figure 7:
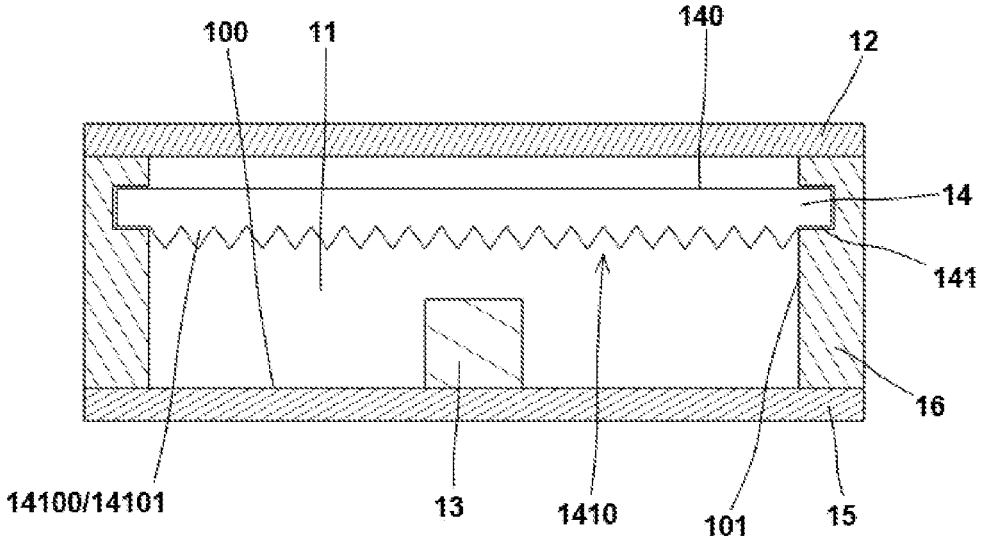
FIG. 7 shows a cross-sectional view of the first embodiment of the lighting module according to the invention.

In an embodiment of the lighting module in FIG. 7, the LED 13 is mounted on the PCB 15, which at the same time constitutes the bottom 100 of the housing 10 of the lighting module 1. On the upper surface of the PCB 15, the side walls 16 of the housing 10 of the lighting module 1 are mounted around the LED 13. The upper surface of the PCB 15 and/or the inner surfaces 101 of the side walls 16 are optionally provided with an unillustrated diffusion layer. The transparent optical filter 14 with the spatial (3D) optical structure 1410 is mounted at the level above the LED 13 in the housing 10 of the lighting module 1, here specifically by means of grooves in the side walls 16. The light-emitting surface 12 is mounted at the upper end of the side walls 16 of the housing 10 of the lighting module 1. This arrangement is suitable for creating entirely separate lighting modules 1.

Figure 8:
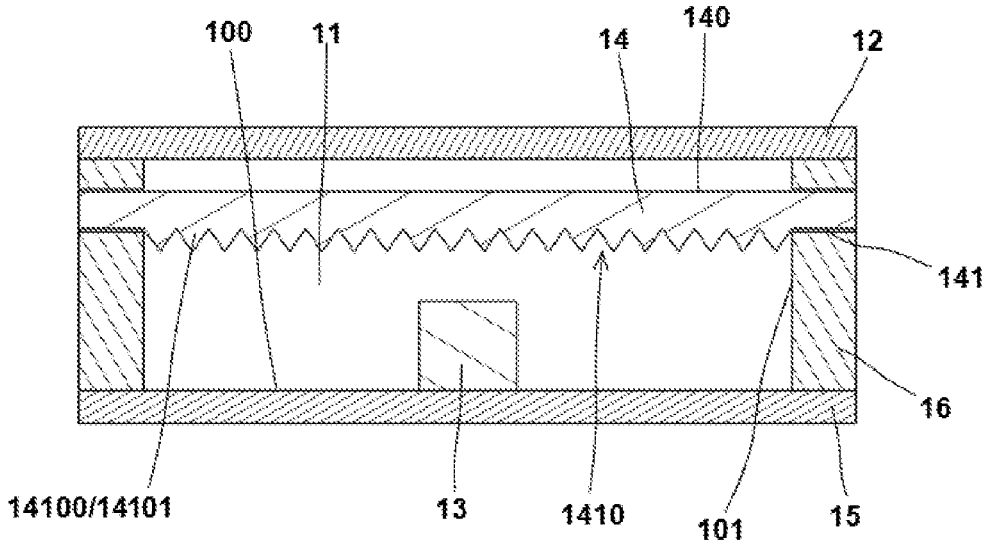
FIG. 8 shows a cross-sectional view of the second embodiment of the lighting module according to the invention.

In an embodiment of the lighting module in FIG. 8, the LED 13 is mounted on its PCB 15 which also constitutes the bottom 100 of the housing 10 of the lighting module 1. On the upper surface of the PCB 15, the side walls 16 of the housing 10 of the lighting module 1 are mounted around the LED 13. Optionally, the upper surface of the PCB 15 and/or the inner surfaces 101 of the side walls 16 are provided with an unillustrated diffusion layer. At the level above the LED 13, the transparent optical filter 14 with the spatial (3D) optical structure 1410 is housed in the housing 10 of the lighting module 10, here specifically by means of passages in the side walls 16. The light-emitting surface 12 is mounted at the upper end of the side walls 16 of the housing 10 of the lighting module 1. This arrangement is suitable for forming an assembly of lighting modules 1 arranged next to each other, because the passages in the side walls 16 for the transparent optical filter 14 allow the transparent optical filter 14 to be formed as a one-piece transparent optical filter 14 for the plurality of lighting modules 1 side by side and at the same time the light-emitting surface 12 can be formed as a one-piece transparent optical filter 14 common to the plurality of lighting modules 1.

Figure 9:
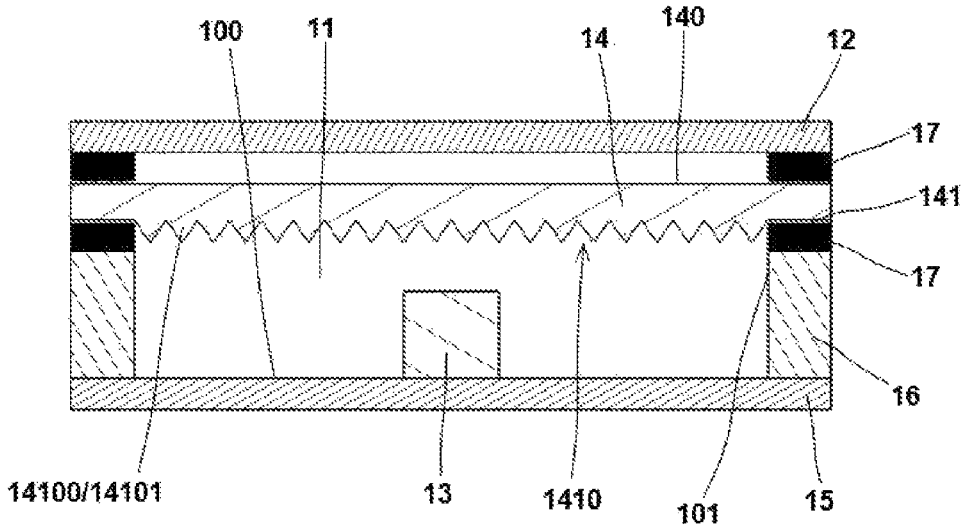
FIG. 9 shows a cross-sectional view of the third embodiment of the lighting module according to the invention.

In an embodiment of the lighting module in FIG. 9, a modified embodiment of FIG. 8 is shown, in which the upper surface 140 and the lower surface 141 of the transparent optical filter 14 are provided with a shielding coating or layer 17 in the area of their passage through the side wall 16 of the housing 10 of the lighting module 1 to limit light leakage from the displayed lighting module 1 to the adjacent lighting module 1. This arrangement, too, is suitable to form an assembly of side-by-side lighting modules 1, because the passages in the side walls 16 for the transparent optical filter 14 allow the transparent optical filter 14 to be formed as a one-piece transparent optical filter 14 for the plurality of lighting modules 1 arranged next to each other and at the same time also the light-emitting surface 12 can be formed as a one-piece transparent optical filter 14 common to the plurality of lighting modules 1.

In an unillustrated embodiment, the shielding coating or layer 17 is formed adhesive for adhering the transparent optical filter 14 to the front surface of the side wall 16 of the housing 10. In another embodiment of FIG. 9, the shielding coating or layer 17 is completely replaced by an adhesive layer, e.g., a double-sided adhesive tape, for adhering the transparent optical filter 14 the front surface of the side wall 16 of the housing 10, wherein the emitting surface 12 is adhered directly to the outer surface of the upper double-sided adhesive tape.

In an embodiment according to FIGS. 8, 9, 11 and 12, the transparent optical filter 14 is either individual for each housing 10 or, conversely, it is common to at least two housings 10 arranged next to each other, ideally so that they either touch each other with their side walls 16 or adjacent housings 10 share a common side wall 16, etc.

In an unillustrated embodiment, the bottom 100 of the housing 10 is formed directly by a PCB 15 containing an LED 13 with all the supporting circuits and elements for the operation of the LED 13, wherein the PCB 15 is adhered by adhesive or a double-sided adhesive tape to the bottom face of the side wall 16 of the housing 10 of the lighting module 1, or it is sandwiched between the side walls 16 of the housing 10.

INDUSTRIAL APPLICABILITY

The invention can be used to create lighting modules with a highly homogeneous surface light output, especially in the field of lighting devices for vehicles, i.e., for the automotive industry.

LIST OF REFERENCES

1 lighting module
10 lighting module housing
100 bottom of the lighting module housing
101 side surface of the cavity of the lighting module
11 cavity of the lighting module
12 light-emitting surface
13 LED
14 transparent optical filter
140 upper surface of the transparent optical filter
141 lower surface of the transparent optical filter
1410 spatial (3D) optical structure
14100 quadrilateral pyramid
14101 cone
15 PCB

16 side walls of the housing
17 shielding coating or layer
a base
α wall opening angle, apex angle
h thickness of the base body of the transparent optical filter

The invention claimed is:

1. A lighting module, for a vehicle lighting device, comprising:

a housing having a cavity which is enclosed with a light-emitting surface enclosing the cavity, the cavity having a bottom and side walls;

an LED mounted in the cavity and connectable to a power source or to a control circuit;

a transparent optical filter arranged between the LED and the light-emitting surface and having a lower surface and an upper surface; and a spatial optical structure on the lower surface of the transparent optical filter and facing the LED, the spatial optical structure is arranged and adapted to:

a) scatter light from the cavity of the housing and deflect the light from the cavity of the housing sideways into the transparent optical filter to incident the deflected light on the upper surface of the filter under a first condition and a second condition, the first condition is for total internal light reflection of most of the deflected light from the upper surface to reflect most of the deflected light from the upper surface back to the spatial optical structure on the lower surface, the second condition is for passing of a minority of the deflected light through the upper surface to the light-emitting surface, b) scatter light reflected from the upper surface back to the cavity of the housing, to the bottom of the cavity and to the side walls of the cavity;

wherein the bottom and the side walls of the cavity are provided with a diffusive layer adapted to reflect light back to the spatial optical structure on the lower surface of the transparent optical filter.

2. The module of claim 1, wherein the light-emitting surface is received in the sidewalls of the housing.

3. The module of claim 1, wherein the spatial optical structure comprises a plurality of geometric structures.

4. The module of claim 1, wherein the spatial optical structure comprises a plurality of pyramids.

5. The module of claim 1, wherein the spatial optical structure comprises a plurality of cones.

* * * * *